United States Patent [19]

Goeller et al.

[11] Patent Number: 4,593,708

[45] Date of Patent: Jun. 10, 1986

[54] HEATED BRISTLE CURLING BRUSH

[75] Inventors: Loretta D. Goeller, Rowayton; Jorgen Skovdal, Trumbull, both of Conn.

[73] Assignee: Clairol Incorporated, New York, N.Y.

[21] Appl. No.: 597,950

[22] Filed: Apr. 9, 1984

[51] Int. Cl.[4] ..... A45D 1/00

[52] U.S. Cl. ..... 132/9; 132/37 R; 219/222

[58] Field of Search ..... 132/9, 85, 33 R, 11 R, 132/148, 159; 219/222

[56] References Cited

U.S. PATENT DOCUMENTS

| | | | |
|---|---|---|---|
| 3,459,199 | 8/1969 | Connell | 132/11 A |
| 3,563,251 | 2/1971 | Jorgensen | 132/33 R |
| 3,581,055 | 5/1971 | Makino | 132/33 R |
| 4,196,489 | 4/1980 | Hahn | 132/85 |
| 4,197,448 | 4/1980 | Harigai | 132/9 |
| 4,198,558 | 4/1980 | Benty | 132/9 |
| 4,250,902 | 2/1981 | Ihara | 132/9 |
| 4,368,376 | 1/1983 | Andis | 132/85 |
| 4,504,998 | 3/1985 | Price | 132/85 |

FOREIGN PATENT DOCUMENTS

| | | |
|---|---|---|
| 1103156 | 2/1968 | United Kingdom . |
| 1558737 | 1/1980 | United Kingdom . |

*Primary Examiner*—Gregory E. McNeill

*Attorney, Agent, or Firm*—Gene Warzecha; John J. Balser

[57] ABSTRACT

The present invention relates a heated curling brush with bristles which are relatively tangle free in use. The heated curling brush of the present invention is provided with bristles which are capable of transmitting heat to the hair while at the same time avoiding the undesirable tangling resulting from use of prior art brushes.

2 Claims, 3 Drawing Figures

HEATED BRISTLE CURLING BRUSH

FIELD OF THE INVENTION

The present invention relates to a heated bristle brush for styling hair without tangling the hair or irritating the scalp.

BACKGROUND OF THE INVENTION

There have been numerous attempts in the prior art to provide a means for effectively and easily brushing and curling hair with a heated brush. Typical of the prior art attempts to provide suitable brush means are U.S. Pat. Nos. 675,527; 1,258,375; 1,393,635; 1,436,957; 4,030,158; 4,314,137; and 4,368,376.

These devices fall into two classes, first, brushes used solely for brushing hair typified by U.S. Pat. Nos. 675,527; 1,258,375; 1,393,635; 1,436,957; and 4,030,158 which are used primarily for brushing hair in straight strokes and to provide body and to assist in drying of hair when used with drying devices commonly known as blow dryers; and second, heated curling irons or brushes used to style the hair and impart a wave thereto typified by U.S. Pat. Nos. 4,314,137 and 4,368,376.

Although brushes in the former group are generally satisfactory for conventional brushing, they are unsuitable for curling or waving hair. As to the latter group, it has been found that while generally they perform the function for which intended, i.e., to curl or wave the hair, there is a tendency for the hair to tangle in the curling brush or to be snarled by use of the brush. Furthermore, brushes of either type, can, depending on their construction irritate or scratch the scalp when used.

In addition, where metal bristles are employed, user contact with the heated bristles can result in painful contact, particularly when the user grips the ends of the hair to keep the ends from slipping off the curler brush when rotation of the hair on the curler is started.

Another problem that arises with the use of prior art brushes is that tangling occurs from twisting the brush while winding the tresses. Bristle curling brushes designed according to prior art techniques frequently cause tangling after several rotations of hair around the brush, as the pins or bristles become caught in the underlying hair. Such brushes generally are constructed of metal pins or plastic teeth mounted in a support structure which terminates in a handle. Tangling of the hair can occur in brushes having either metal pins or plastic teeth. However, the plastic teeth of some prior art brushes do not permit more than one layer of hair to get below the tips of the teeth and in such brushes, the tangling problem is less severe. In brushes having metal bristles, on the other hand, the shape, flexure and friction coefficient of the pins does permit layers of hair to slide down the pins and it has been found that severe tangling of the hair results.

In addition to the aforementioned prior art devices employed to brush or curl the hair, there is yet another category of devices commonly employed in hair curling. These are generally referred to as hair curlers or winders and are externally heated, cylindrical devices around which several layers of hair are wrapped after the device has been preheated to aid in curling. Typical of these devices are U.S. Pat. Nos. 3,556,887 and 3,706,315. Although these devices are suitable for hair curling, they are unsuitable for use in brushing hair. Furthermore, because of their design, they are restricted as to the number of layers of hair, generally one or two, which can be wound through the tabs or spades of the winder.

The size and spacing of the heated bristles should preferably be such as to prevent the users' fingers from being able to touch the barrel. Users generally do not intentionally touch the barrel. Instead, they place their fingers on top of the hair ends when starting rotation of the brush to keep the ends from slipping off. In placing their fingers in such a manner, the users make contact with the bristles. With plastic bristles this is not as much of a problem since they are cooler and do not conduct heat as readily. However, with devices having bristles of heat-conductive composition, painful contact with the bristles adjacent to the heated housing can occur. This problem is substantially reduced by the instant invention which minimizes the need for the user to have to grip the ends of the hair in order to start rotation of the brush. The gripping of the hair ends during start of rotation may be accomplished by providing a barrel surface having dimples, a roughened surface, a flocked surface or a rubber surface.

The tips of the bristles used in the heated curling brushes of the present invention which are in contact with the scalp should be relatively smooth to avoid scalp irritation during use. The tips may be coated or rounded to provide the desired smooth surface.

SUMMARY OF THE INVENTION

The present invention relates to a heated bristle curling brush comprising a handle, a barrel extending from the handle, including an interiorly located heating element, and having a longitudinal axis, and an outer peripheral surface radially spaced from the longitudinal axis, which outer surface includes therealong a plurality of angularly spaced rows of longitudinally spaced and radially outwardly extending bristles, the base of each occupying an arc of about 20° to about 110° on the circumference of the barrel and the height of the bristles being at least one half of the diameter of the barrel, but not less than about 0.375 inch. Preferably the diameter of the barrel is 0.375 inch to 2.0 inches, and more preferably 0.5 inch to 1.0 inches, wherein the height of the bristles is at least one half the diameter of the barrel, but not less than about 0.375 inch. The distance between adjacent rows of bristles spaced longitudinally along the barrel is sufficient to permit the brush to move through the hair, preferably between about 0.125 inch to 0.75 inch and more preferably about 0.25 inch.

The unique design of the bristles used in the brushes of the present invention does not cause tangling. The reasons for this depend on the type of tangling which could occur. A small bristle, such as a straight pin, can pierce an already tangled clump of hair, while the bristles of the present invention will have the tangle fall on one side or the other. A second way that tangling can occur is from twisting the brush while winding the tress. If the tress is lying taut on the barrel, changing the angle will not cause tangling, but twisting the barrel when some of the hair is looser than the rest and the hair is entwined, can cause entanglement. The hair, when not taut, can be interwoven between the pins when being wound-up. Removal, after the hair has been pulled taut so that it lays flat on the barrel, is not as easy because it is nearly impossible to reverse the random manner in which the hair is interwoven around the pins.

Tangling does not occur with the curling brushes of the present invention because the unique bristle configuration requires the path into the underlying hair and the path out to be the same so hair no longer becomes wound around the bristles. This shape also permits the hair to slide down the pins for better heating of all the layers wrapped around the brush.

In a preferred embodiment, the bristles are arcs formed of metal with end or base of each bristle in thermal contact with the barrel. Both ends of the bristles make contact with the inner core beneath the outer housing of the barrel so the bristles are heated by the heating means within the core. Although heating may be provided by commonly used positive temperature coefficient or electric resistance heater units, it is well recognized that alternate forms of heating such as butane catalytic heaters or forced hot air may be employed.

The various embodiments of the present invention avoid the aforementioned tangling problems. With each bristle having a height of at least about one half inch and having a base being a significant portion of an arc of about 20° to about 110°, the hair cannot readily be interwoven between the rows as it is being rolled on the brush or looped around one bristle and pulled taut. It is also possible to weave hair from one side of one row of bristles to the other side of the next row of bristles, but weaving the hair over three rows and then looping it back can no longer occur since the loops separate the hair like comb teeth as they enter the hair. The bristles need not be in symmetrical configuration in order to provide the desired results of the present invention.

In the preferred embodiment employing metal bristles in arch configuration having semi-rounded distal tips, the bristles are spaced so that they occupy an arc of about 20° to about 50° spaced around the circumference of the barrel, the rows of such bristles spaced longitudinally along the barrel being spaced at about 0.25 inch intervals to prevent the user from inserting a finger between such bristles and prevent contact with the heated outer barrel of the brush.

The bristles of the present invention permit the transfer of heat from a relatively hot barrel, i.e. 120° to 150° C. to the adjacent hair in contact with the bristles while simultaneously providing a bristle tip temperature of about 40° to 70° C. and preferably 60° to 70° C. The structure of the present invention enhances the thermal contact between the bristles and the heated inner core and enables the efficient transfer of heat from the core to the bristle tips. This structure has been found to enable the bristle tips to reach a satisfactory operating temperature with the use of a lower temperature heated core than is possible with straight thin shaped bristles.

DESCRIPTION OF THE INVENTION

Figure 3:
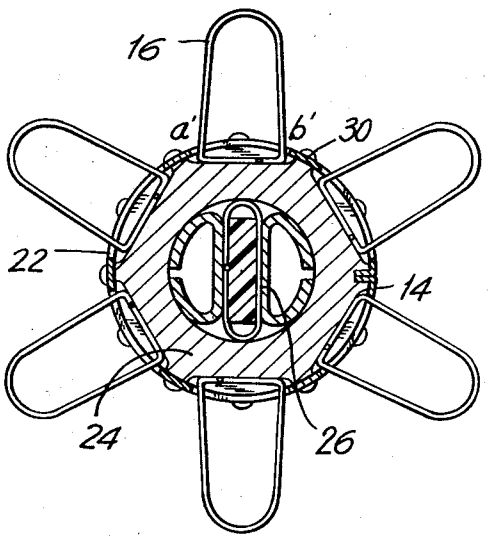
FIG. 3 is a cross sectional view of the heated bristle brush shown in FIG. 1 taken along line 3—3.
Figure 1:
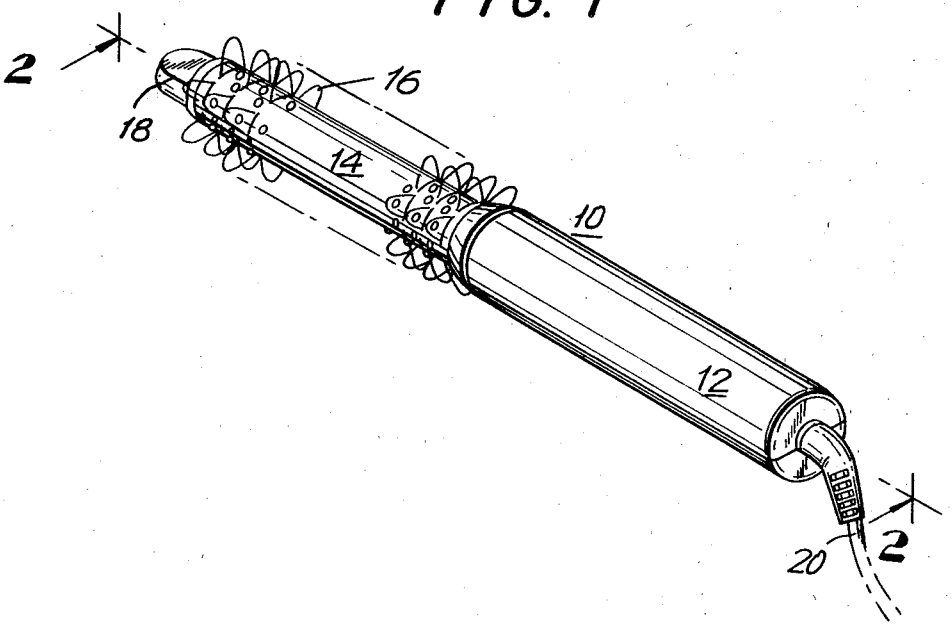
FIG. 1 is a perspective view of a preferred embodiment of the heated bristle brush of the present invention.
Figure 2:
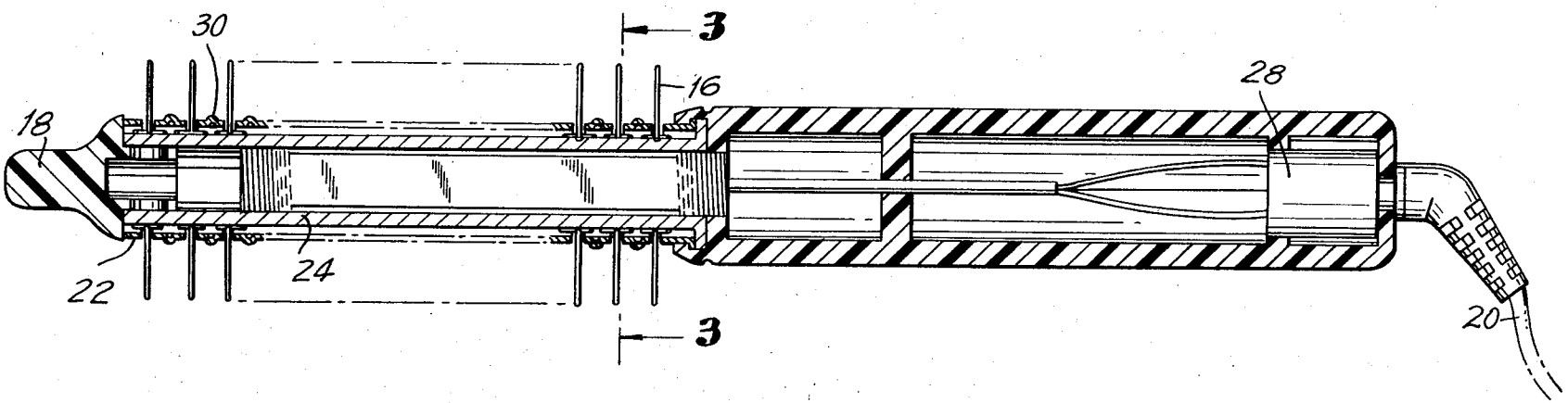
FIG. 2 is an axial sectional view of the heated bristle brush shown in FIG. 1.

As shown in the drawings, the heated bristle brush of the present invention 10 comprises a handle 12, a barrel 14, bristles 16 radially spaced on said barrel 14, an end cap 18 and line cord 20. Barrel 14 is comprised of a barrel housing 22 which has located therewithin inner core 24 and heating element 26 connected to line cord 20 in handle 12 at terminal 28. Optionally displaced from the surface of barrel housing 22 are nubs or dimples 30. Although barrel 14 as shown has a barrel housing 22 and an inner core 24, it is also contemplated that barrel housing 22 and inner core 24 could comprise an unitary component.

The bristles 16 are preferably constructed of metal to facilitate heat transfer from heating element 26 through inner core 24 and barrel housing 22 in communication therewith and thence to bristles 16. Alternatively, the bristles may be constructed of any substantially rigid, thermo-conductive plastic material. The metal bristles may be constructed of a highly heat conductive metal such as copper, aluminum, or steel; stainless steel being the preferred metal for reasons of economy and appearance. The bristles will be constructed from wire or metal stampings to provide maximum heat transfer and low weight while at the same time substantially eliminating the tangling problems encountered by use of prior art metal pin bristle brushes. As will be noted in FIG. 3, bristles 16 may be formed individually (in "loops") arranged radially about core 24 and aligned in longitudinal rows 40. Bristles 16 are fastened to and maintained in contact with inner core 24 by barrel housing 22. The base of each bristle 16 is formed flat to provide a good thermally conductive contact with the surface of core 24 which is provided with a plurality of longitudinal flat grooves 42 for facilitating the thermal contact. Barrel housing 22 is a tubular sheath or cover (made of, for example, stainless steel) provided with slots through which bristles 16 project. Alternatively, bristles 16 may be fastened by any other commonly known fastening means which will permit bristles 16 to contact inner core 24 and be heated thereby. Typically, the barrel could be provided with extruded slots which would permit insertion of the metal loop bristles or replacement thereof with other combs.

The foregoing is a description of the preferred embodiment of the invention, and variations may be made without departing from the spirit or scope of the invention, as defined by the appended claims.

What is claimed is:

1. In an internally heatable hair curling brush comprising a handle, a barrel extending from said handle, said barrel having a longitudinal axis, an outer heat conducting cylindrical surface radially spaced from the longitudinal axis and a heater for heating same, the improvement which comprises a plurality of arch-shaped, heat conducting loop bristles spaced around and in heat conducting relationship with said outer cylindrical surface, said bristles arranged in a plurality of parallel, axially spaced bristle groups, each one of said groups comprising a plurality of said bristles, the base of each of said bristles subtending a predetermined arc on said outer cylindrical surface, the number of bristles in any one of said groups being such that a predetermined arcuate gap exists between the bases of adjacent bristles in a group, the bristles of all said groups axially aligned with each other to form longitudinal rows of said bristles.

2. An internally heatable hair curling brush according to claim 1 wherein each one of said heat conducting loop bristles is provided with a substantially flat base portion in mateable contiguous heat conducting engagement with a corresponding slot in said outer cylindrical surface and wherein said bristles are retained adjacent said outer cylindrical surface by an apertured housing concentric to said outer cylindrical surface.

* * * * *